United States Patent [19]

Sugiura et al.

[11] Patent Number: 4,809,609

[45] Date of Patent: Mar. 7, 1989

[54] METHOD OF DIRECTLY MOUNTING A PRINTING PLATE ON PLATE CYLINDER AND THE PLATE CYLINDER AND REGISTER PINS USED IN SAID METHOD

[75] Inventors: Masahiro Sugiura; Michiyuki Yoshida; Yoshiaki Nakatsuji, all of Osaka, Japan

[73] Assignee: Sakata Shokai, Ltd., Osaka, Japan

[21] Appl. No.: 776,530

[22] Filed: Sep. 16, 1985

[30] Foreign Application Priority Data

Sep. 19, 1984 [JP] Japan ..... 59-196136
Mar. 28, 1985 [JP] Japan ..... 60-45894[U]

[51] Int. Cl.[4] ..... B41F 27/12; B41N 1/22

[52] U.S. Cl. ..... 101/426; 101/401.1; 101/415.1; 33/618

[58] Field of Search ..... 101/415.1, 382 R, DIG. 12, 101/401.1, 426; 33/615, 618, 621; 430/306, 307

[56] References Cited

U.S. PATENT DOCUMENTS

| | | | |
|---|---|---|---|
| 1,607,267 | 11/1926 | Lublintz et al. | 101/DIG. 12 X |
| 2,226,987 | 12/1940 | Wiegand | 101/DIG. 12 X |
| 2,277,405 | 3/1942 | McKiernan | 101/DIG. 12 X |
| 2,283,587 | 5/1942 | Steinbach | 101/DIG. 12 X |
| 2,395,063 | 2/1946 | Paulus | 411/411 |
| 2,491,027 | 12/1949 | Beleher et al. | 101/DIG. 12 X |
| 2,512,940 | 6/1950 | Junke | 101/415.1 |
| 2,629,234 | 2/1953 | Smith | 101/415.1 |
| 2,631,349 | 3/1953 | Houston | 101/415.1 X |
| 2,714,852 | 8/1955 | Stempel | 101/415.1 |
| 2,977,876 | 4/1961 | Myers | 101/415.1 X |
| 3,128,200 | 4/1964 | Kunetka | 101/395 X |
| 3,380,381 | 4/1968 | Musgrave | 101/415.1 |
| 3,621,582 | 11/1971 | Radencic | 101/DIG. 12 X |
| 3,882,775 | 5/1975 | Lytle et al. | 101/415.1 |
| 3,889,972 | 8/1975 | Albright | 101/415.1 |
| 4,179,990 | 12/1979 | Radencic | 101/DIG. 12 X |
| 4,408,529 | 10/1983 | Johne et al. | 101/415.1 |
| 4,408,531 | 10/1983 | Okamura et al. | 101/415.1 |

*Primary Examiner*—Charles A. Pearson
*Attorney, Agent, or Firm*—Wenderoth, Lind & Ponack

[57] ABSTRACT

A printing plate is directly mounted on a plate cylinder by first placing small holes in the non-image area of the printing plate on register holes in the plate cylinder and by then inserting register pins through the small holes and into the register holes so that the two holes are brought into complete registry with each other. Remounting a removed printing plate at the same position on the cylinder at which it was mounted before may be readily performed by relying on X-Y coordinates of the previous position for finding the corresponding register holes and then by reperforming the method as described above. This will result in a considerable reduction in the manpower required for the plate mounting operation and in the subsequent work to bring the plate into accurate registry with the cylinder.

1 Claim, 4 Drawing Sheets

METHOD OF DIRECTLY MOUNTING A PRINTING PLATE ON PLATE CYLINDER AND THE PLATE CYLINDER AND REGISTER PINS USED IN SAID METHOD

BACKGROUND OF THE INVENTION

1. Field of the Invention

The present invention relates to a method of directly mounting a printing plate on a plate cylinder of a printing press for flexographic printing or letterpress printing and similar printing methods and the plate cylinder and register pins used in that method. More particularly, the invention relates to a method that facilitates direct mounting of a printing plate on a cylinder plate with accurate registry by forming small holes in the non-image area portion of the printing plate corresponding to the register holes made in the outer surface of the peripheral wall (hereunder referred to as simply the outer surface) of the plate cylinder and by bringing the small holes of the printing plate into registry with the register holes made in the plate cylinder. Furthermore, the invention provides for registrations both in a process of plate-making using a photopolymer plate and in a process of the mounting of the plate on the plate cylinder by using as a reference the register holes made in the outer surface of the plate cylinder, and small holes made in an original film and small holes made in the printing plate or in an unexposed photopolymer plate.

2. Description of Prior Art

A printing plate is conventionally mounted on a plate cylinder of a printing press by one of the following two methods in flexographic printing: (1) a carrier sheet typically made of a polyester film to which the printing plate is attached is wrapped around the plate cylinder; (2) the printing plate is directly mounted on the plate cylinder. The former method requires a great deal of skill or a special apparatus for mounting the printing plate on the carrier with accurate registry. In addition, registration is also required after the mounting of the carrier on the plate cylinder when the carrier is not wrapped with accurate registry. Furthermore, this method is not suitable for endless printing because the printing plate cannot be mounted on that part of the outer surface of the plate cylinder which is covered with the apparatus for fastening and removing the carrier.

The second method is compatible with continuous endless printing since it permits the printing plate to be mounted at a desired position on the plate cylinder. However, considerable difficulty is involved in accurately mounting the printing plate on the cylinder without a great deal of skill. In current practice, the cylinder is always removed from the printing press and the plate is precisely mounted on the cylinder with a special mounting/proofing machine. Furthermore, when the operator wishes to shift to another printing job, he must remove the first printing plate and mount the next printing plate by repeating the same procedures all over. If the operator wants to omit the steps of removing one printing plate and mounting another, he has to keep at hand as many cylinders as are necessary for performing the intended printing jobs, but this is undesirable for two reasons: firstly, a large space is required for storing the necessary number of cylinders, and secondly, it is expensive to purchase many cylinders. Further problems arise from the heavy weight of the cylinders such as removal of a cylinder from the printing press of remounting it on the press will not only present a great hazard to the operator but may also cause damage to associated parts such as gears for driving the plate cylinder.

SUMMARY OF THE INVENTION

It is an object of the invention to provide an efficient method for directly mounting a printing plate on a plate cylinder that permits easy registration without using a special device or equipment for mounting operations.

It is another object of the invention to provide the plate cylinder and register pins suitably used in the efficient method for directly mounting a printing plate on the plate cylinder.

Other objects and advantages of the present invention will become apparent to those skilled in the art from the following description and figures.

DESCRIPTION OF THE PREFERRED EMBODIMENT

In accordance with one aspect of the present invention, a method for directly mounting a printing plate on a plate cylinder is provided wherein a printing plate having small holes made at those locations in the non-image area portion which correspond to register holes made in that portion of the cylinder where the printing plate is to be mounted is placed on the cylinder, said small holes being placed on the appropriate register holes in the cylinder and being brought into registry with the latter by suitable means such as pins.

In accordance with another aspect of the invention, a plate cylinder for use in direct mounting of a printing plate is provided wherein a register X-Y coordinate system is marked on the surface of the cylinder, with register holes being made in the outer surface of the cylinder at locations that correspond to selected coordinates so that pins that enable registered placement of the printing plate may be inserted into said holes.

DETAILED DESCRIPTION OF THE INVENTION

Figure 1:
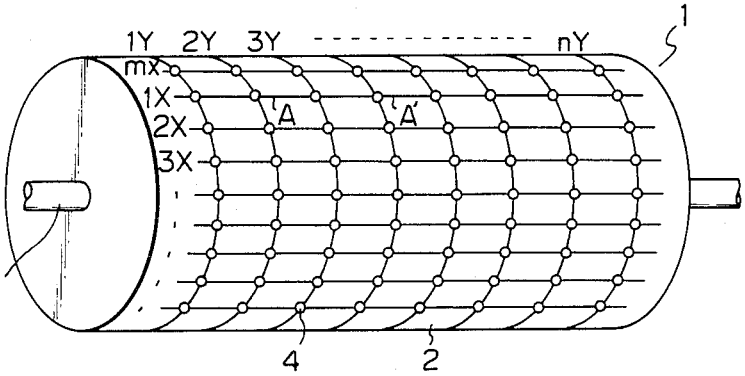
FIG. 1 is a schematic diagram of a plate cylinder that may be used in implementing the method of the present invention.

The method of the present invention for enabling the directly mounting a printing plate on a plate cylinder is hereunder described by reference to the accompanying drawings. FIG. 1 is a schematic view of one embodiment of the plate cylinder used in the present invention that is provided with register holes for facilitating the mounting of the print plate with accurate registry. In the Figure, the cylinder is denoted by 1, its outer surface by 2 and the axis about which the cylinder rotates is indicated by 3. An X-Y coordinate system is marked on the outer surface of the cylinder 2 and the points at which the abscissae consisting of equidistant 1X, 2X, . . . mX intersect the ordinates consisting of equidistant 1Y, 2Y, . . . nY are used as indices for registering on the outer surface of the cylinder. Register holes 4 are made on the respective coordinates.

FIG. 2 is a partially enlarged cross-sectional view of the surface of the plate cylinder as taken along line A—A′ in FIG. 1 in the axial direction of the cylinder; FIGS. 2A, 2B, 2C and 2D show different embodiments of register holes and register pins having different configurations. As shown in FIG. 2A, a register hole 4 is made in the outer surface of the plate cylinder and a register pin 5 is inserted into the register hole 4.

Figure 2A:
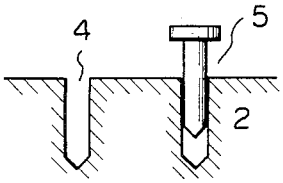
FIG. 2A shows an embodiment of the present invention of a register hole that may be made in the outer surface of the cylinder and a register pin inserted into a register hole.
Figure 2B:
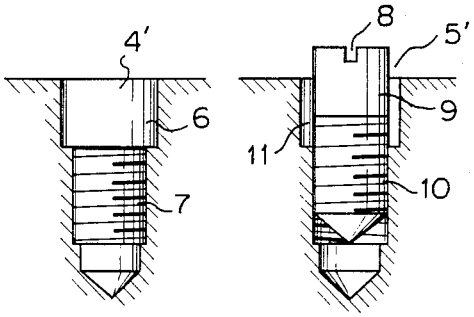
FIGS. 2B, 2C and 2D show other embodiments of register pins and register holes according to the present invention.

FIG. 2B shows a register pin 5′ designed to be insertable into the register hole. In this Figure, the register hole is denoted by 4′ and consists of two portions, a portion 6 for accommodating the body of the register pin and a portion for accommodating a female thread 7. The head of the register pin 5′ is provided with a slot 8 into which the wedge-shaped end of a screwdriver can be fitted. The body 9 of the pin rests in a hole in the printing plate, and the male thread 10 in the lower portion engages the female thread 7 in the register hole 4′. Some clearance is provided between the inner surface of the area 6 and the body 9 of the register pin. The register pin 5′ is inserted into each of the register holes 4′ in the outer surface of the plate cylinder, and before the printing plate is mounted on the cylinder, the necessary number of register pins 5′ are loosened by turning them with a screwdriver or other suitable tool so that the pin projects above the surface of the cylinder and so that the printing plate can be properly registered on the cylinder.

Figure 2C:
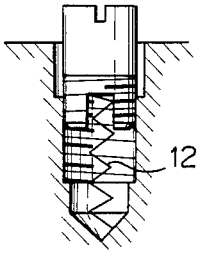
Figure 2D:
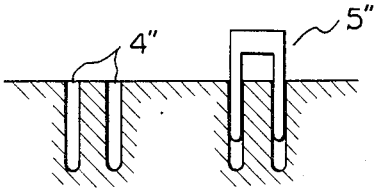

FIG. 2C shows another embodiment wherein the register pin 5′ and register hole 4′ shown in FIG. 2B are connected by a spring 12 or other suitable means so as to avoid any accidental loss of the pin 5′. FIG. 2D shows still another embodiment wherein a hollow register pin 5″ engages a register hole 4″ having a corresponding shape.

The register pins having the various configurations shown above must be such that they will, when inserted into the register holes and/or small holes, ensure precise registration between the printing plate and the underlying plate cylinder. But, considerable difficulty would result when inserting the register pin into the hole or removing the former from the latter when the size (e.g. inside diameter) of the register hole is made equal to the size (e.g. outside diameter) of the body of the register pin is order to avoid misalignment arisen from the difference in size between the pin and the hole.

Therefore, in accordance with a further aspect of the present invention, these problems are solved by using a register pin having a special configuration, i.e. a pin having an elongated hole that extends through the center of the body of the pin and which is open at its top.

Figure 3A:
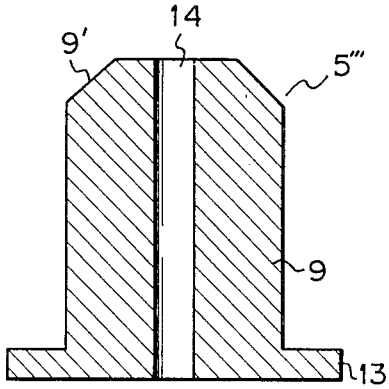
FIGS. 3A and 3B show the configuration of a modification of the register pin shown in FIG. 2A, FIG. 3A being a longitudinal section taken along line B—B′ of FIG. 3B which is a plan view.
Figure 3B:
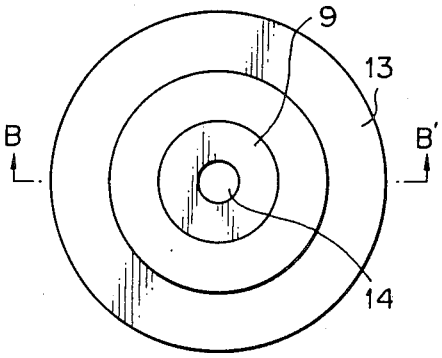

An embodiment of the register pin according to this aspect of the present invention is shown in FIGS. 3A and 3B wherein the pin generally indicated at 5‴ has a circular cross-section. FIG. 3A is a longitudinal section taken along line B—B′ of FIG. 3B, which is a plan view of the pin. In FIGS. 3A and 3B, the plate provided on top of the register pin is denoted by 13, and the body of the pin by 9. The elongated hole extending through the body 9 and which is open at the top plate 13 is indicated by 14 and the edge of the bottom of the body 9 is chamfered as indicated by 9′.

Even if the inside diameter of the register hole 4 is finished so that it has a good and precise fit relative to the body 9 of the register pin 5‴, the through-hole 14 serves as both an air vent and a stress relaxation element in the register pin to ensure a highly accurate registry between the pin and hole while allowing inserting the pin into the hole or removing the former from the latter to be done very easily.

The body 9 of the register pin 5‴ must have a size that closely fits the opening of the register hole 4 made in the outer surface of the plate cylinder. The opening of the register hole should not cause any change in the degree of printing impression squeeze exerted during printing operations; the diameter of the opening is generally not more than about 10 mm, preferably not more than about 5 mm, while at least about 1 mm is preferred from the viewpoint of the manufacture of register pins. Therefore, the body of the register pin generally has a diameter in a range of about 1 to 10 mm, preferably between about 1 and 5 mm.

The length of the register pin 5 is determined both by the depth of the register hole 4 which generally ranges from about 2 to 25 mm and by the thickness of the printing plate. The pin typically ranges from about 5 to 10 mm in length. For the purposes of the invention, the top plate 13 of the pin may have a size that ranges from about 1.2 to 3.0 times the diameter of the body of the pin. The thickness of the top plate 13 of the pin may be within the relief-depth of the printing plate to be mounted on the plate cylinder. Generally, the thickness of the top plate is within a range of about 0.2 to 5 mm. The diameter of the through-hole is within a range of about 10 to 30% (about 0.2–2 mm) of the diameter of the body of the register pin.

Figure 4:
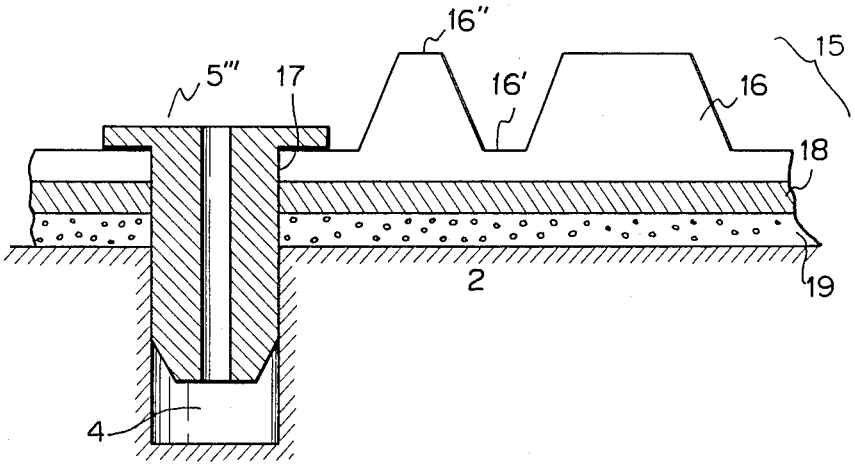
FIG. 4 is a partially enlarged cross-sectional view of the outer surface of a plate cylinder where the printing plate is brought into complete registry by the register pins shown in FIGS. 3A and 3B.

FIG. 4 is a partially enlarged cross section of the outer surface of the printing cylinder 2 where the printing plate 15 made from a photopolymer plate is mounted with accurate registry using the register pin 5‴ shown in FIGS. 3A and 3B. The printing plate 15 consists of a resin layer 16 and supporting sheet (e.g. polyester film) 18, said supporting sheet 18 supporting a resin layer 16, and the supporting sheet 18 bonded to the outer surface 2 of the printing cylinder with an adhesive layer 19. The small holes 17 made in the non-image area (concave area) 16′ portion of the resin layer 16 of the printing plate 15 are brought into registry with the corresponding register holes 4 in the outer surface 2 of the cylinder and a register pin 5''' or any other suitable device is inserted through the small hole 17 and into the underlying register hole 4 so as to ensure accurate registry between the printing plate and the cylinder. The register pin 5''' is thereafter removed and the printing plate is used in subsequent printing operations. If the top of the inserted register pin 5''' is lower than the image areas projected areas 16'' of the printing plate, the printing operation may be immediately done with the pin inserted in the plate but protected against any accidental slip out of the hole by a suitable means.

The register pin 5 may be made of any material that is corrosion-resistant and has high durability. Since the pin must be subjected to cyclic use, it is preferably made of stainless steel.

Figure 5A:
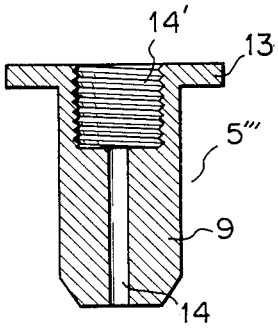
FIG. 5A is a longitudinal sectional view of a modification of the register pin shown in FIGS. 3A and 3B provided with a threaded hole 14′.
Figure 5B:
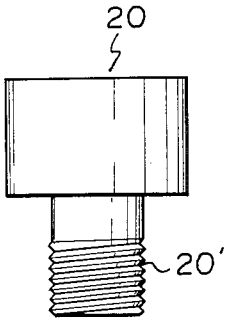
FIG. 5B is a front view of an insert member 20 that has a male thread 20′ and which is fitted into the register pin shown in FIG. 5A to be pulled up for removing the register pin.
Figure 6:
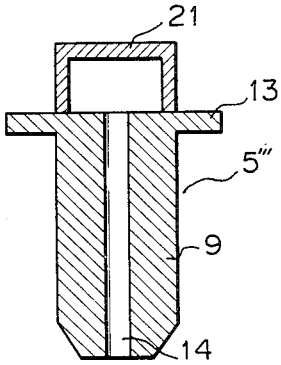
FIG. 6 is a longitudinal sectional view of a modification of the register pin shown in FIGS. 3A and 3B that is provided with a grip 21 that facilitates the removal of the pin.

While the register pin of the present invention has the configuration shown above, it may have other configurations so that even higher efficiency may be provided during the removal of the register pin from the printing plate. Two examples of such alternative configurations are illustrated in FIGS. 5A and 6. In the embodiment shown in FIG. 5A, a threaded hole 14' is provided that is open to the through-hole 14 on the side of the top plate 13. After placing the printing plate in registry with the plate cylinder, the register pin 5 may be readily removed by using an insert member 20 (see FIG. 5B) that has a male thread 20' for engaging the female thread 14' and which is threaded into the top of the register pin, the latter being subsequently pulled upward together with the member 20.

FIG. 6 shows another embodiment wherein the register pin is provided wit a grip 21 by which the pin is pulled out of the hole. If the grip 21 on the register pin inserted in the printing plate is more elevated than the height of the printing plate, the pin must be removed after the desired registry between printing plate and plate cylinder has been achieved.

The foregoing description is directed to the case where the body of the register pin has a circular cross-section. It should be understood that the body of the register pin may be elliptical or polygonal in cross-section. However, from the viewpoint of making the register hole and register pin easily, a circular cross-section is the simplest and hence is preferred.

Figure 7:
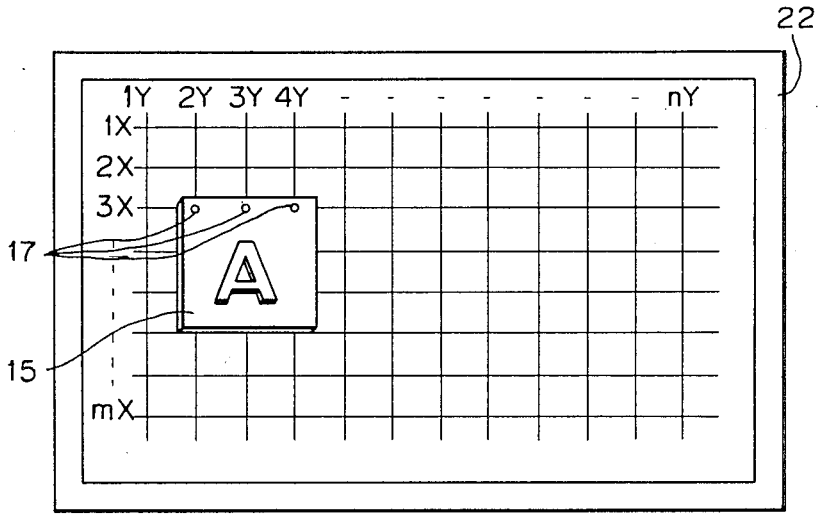
FIG. 7 is a schematic diagram of a proofing table for designating the position on the cylinder where the printing plate is to be mounted and the position of the small holes in the printing plate corresponding to the register holes in the surface of the cylinder.

The printing plate that is to be mounted on the plate cylinder is provided with small holes that are made in the non-image area portion at locations corresponding to the register holes by the method which is hereunder described by reference to FIG. 7. The Figure shows an example of the proofing table that is used to designate the position on the plate cylinder where the printing plate is to be mounted. It consists of a suitable flat table marked with a coordinate system corresponding to the X-Y coordinates drawn on the plate cylinder. Both the location at which the printing plate is mounted and locations of the corresponding register holes are determined on this proofing table. In FIG. 7, the proofing table is denoted by 22, the printing plate is denoted by 15 and each of the small holes made in the non-image area portion of the printing plate at points corresponding to the register holes is denoted by 17. The method of making small holes in the non-image area portion of the printing plate starts with determining their respective positions on the proofing table. Then, holes of a size that closely matches the register hole or the body of the insertable register pin are bored with a suitable tool such as a film puncher. The number of small holes to be bored depends on the size of the printing plate used. While small holes may be made in one printing plate, two or three holes will serve the purpose of establishing accurate registry between the printing plate and plate cylinder.

The above method may be straight forwardly used in order to make small holes in the non-image area portion of a printing plate on which an image area has been already formed. The method may also be used in such a case that a printing plate is made from an unexposed photopolymer plate. In this case, an original film is placed at a predetermined position on the proofing table, and after establishing registry with the corresponding register holes, small holes are made in the position on the original film that match the register holes. Another set of small holes are made in the unexposed photopolymer plate by the same procedures. The two sets of holes are put one on the other and after establishing registry between the respective holes by pins or other suitable tools, the photopolymer plate is exposed to light through the original film thereby resulting in a printing plate having small holes in the non-image area that correspond to the register holes in the plate cylinder.

As shown above, the present invention enables all steps necessary for making a photopolymer plate and its subsequent mounting on the plate cylinder to be performed by using register holes in the cylinder as an index. This contributes greatly to the improvement of the overall process efficiency by standardizing the plate making operations and the mounting of the printing plate on the plate cylinder.

The printing plate is mounted on the plate cylinder by first placing small holes of the printing plate on the register holes in the plate cylinder and by then inserting register pins through the small holes and into the register holes so that the two holes are brought into complete registry with each other. The printing plate mounted in registry with the plate cylinder is securely fixed to the latter by any conventional method, such as by using double-faced adhesive tape, a magnet, or by suction with a vacuum. If the operator wants to perform printing again using a removed printing plate, he may readily remount the plate at the same position on the cylinder as used before; all he has to do is to rely on the X-Y coordinates of the previous position for finding the corresponding register holes, then put small holes in the printing plate on those register holes and insert register pins through the holes so that the printing plate is in perfect registry with the plate cylinder.

As shown in the foregoing description, the present invention provides for the mounting of a printing plate on the plate cylinder by indexing the register holes made in the cylinder. This will result in a considerable reduction in the manpower required for the plate mounting operation and the subsequent work to bring the plate into perfect registry with the cylinder.

What is claimed is:

1. A method for directly mounting at least one exposed photopolymer plate on a plate cylinder for flexographic or letterpress printing, the plate cylinder having an outer cylindrical surface on the entirety of which a coordinate system is indicated and a plurality of register holes extending therein that are open to said outer cylindrical surface at positions corresponding to coordinates of said coordinate system, each of the at least one exposed photopolymer plates having an image area portion which defines an image to be printed and a non-image portion, the register holes extending through the plate cylinder spaced from one another along said coordinate system in increments, said method comprising:

forming each said exposed photopolymer plate by initially forming a first set of small holes in an unexposed photopolymer plate which are spaced apart from one another by distances equal to said increments, subsequently forming a second set of small holes in an original film which are spaced apart from one another by distance equal to said increments, said first set of small holes, said second set of small holes and said register holes all having the same cross-sectional size and shape, subsequently superimposing the unexposed photopolymer plate and the original film with the first set of small holes sand the second set of small holes substantially aligned and registering the unexposed photopolymer plate and the original film in a precise position relative to one another by inserting register pins through the substantially aligned first and second sets of holes, and subsequently exposing the unexposed photopolymer plate to light through the original film to form said image area portion;

using the coordinate system indicated on said plate cylinder to determine respective locations on said plate cylinder at which to mount each of said at least one exposed photopolymer plates which will provide a desired image that is to be printed when each of said at least one exposed photopolymer plates are mounted on said printing cylinder at said respective locations;

placing the first set of small holes extending through each of said at least one exposed photopolymer plates over the register holes open to the outer cylindrical surface of the printing cylinder at said respective locations; and registering each of said at least one exposed photopolymer plates on said printing cylinder in a precise position on said printing cylinder at said respective locations with register pin means which are respectively inserted in the register holes open to the outer cylindrical surface of the printing cylinder at said respective locations and which are inserted in the first set of holes placed over said registering holes.

* * * * *